US008387514B2

(12) United States Patent
Kunze

(10) Patent No.: US 8,387,514 B2
(45) Date of Patent: Mar. 5, 2013

(54) HYDROSTATIC PISTON MACHINE WITH OUTPUT VOLUME FLOW IN THE CIRCUMFERENTIAL DIRECTION

(75) Inventor: Thomas Kunze, Nagold (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 1269 days.

(21) Appl. No.: 12/097,176

(22) PCT Filed: Dec. 11, 2006

(86) PCT No.: PCT/EP2006/011919

§ 371 (c)(1),
(2), (4) Date: Jun. 12, 2008

(87) PCT Pub. No.: WO2007/068431

PCT Pub. Date: Jun. 21, 2007

(65) Prior Publication Data

US 2008/0295680 A1 Dec. 4, 2008

(30) Foreign Application Priority Data

Dec. 13, 2005 (DE) ..... 10 2005 059 565

(51) Int. Cl.

| | |
|---|---|
| ***F01B 3/00*** | (2006.01) |
| ***F01B 13/04*** | (2006.01) |
| ***F04B 37/00*** | (2006.01) |
| ***F04B 7/06*** | (2006.01) |

(52) U.S. Cl. ..... 91/503; 417/461; 417/501

(58) Field of Classification Search ..... 91/485, 91/503, 499; 92/71; 417/222.1, 222.2, 269, 417/271, 460, 461, 462, 466, 469, 471, 500, 417/501, 415, 439, 490, 521, 534
See application file for complete search history.

(56) References Cited

U.S. PATENT DOCUMENTS

| | | | | |
|---|---|---|---|---|
| 3,170,297 | A * | 2/1965 | Larson | 60/325 |
| 5,440,878 | A * | 8/1995 | Gleasman et al. | 60/487 |

FOREIGN PATENT DOCUMENTS

| | | | |
|---|---|---|---|
| DE | 976 964 | B | 9/1964 |
| DE | 1 211 943 | B | 3/1966 |
| DE | 30 18 711 | A1 | 2/1981 |
| DE | 30 187 11 | C2 | 2/1981 |
| DE | 42 29 544 | A1 | 3/1993 |
| DE | 195 21 574 | A1 | 12/1996 |
| DE | 197 06 114 | A1 | 8/1998 |
| DE | 102 06 957 | A1 | 8/2003 |
| DE | 10 2004 007 933 | B3 | 6/2005 |
| JP | 54-44208 | | 4/1979 |

* cited by examiner

*Primary Examiner* — Devon Kramer
*Assistant Examiner* — Bryan Lettman
(74) *Attorney, Agent, or Firm* — Scully, Scott, Murphy & Presser, P.C.

(57) ABSTRACT

A hydrostatic piston machine with a cylinder drum, which is rotatably mounted in a housing, is provided. A plurality of cylinder bores are disposed in the cylinder drum, which bores can be connected via cylinder openings provided in the cylinder drum to a first control opening and a second control opening. The first control opening is connected to a low-pressure line and the second control opening to a high-pressure line. The first control opening is connected via a first connection and a second connection to a channel, wherein the first connection and, lying opposite, the second connection are disposed at the first control opening.

9 Claims, 3 Drawing Sheets

HYDROSTATIC PISTON MACHINE WITH OUTPUT VOLUME FLOW IN THE CIRCUMFERENTIAL DIRECTION

BACKGROUND

The invention relates to a hydrostatic piston machine.

In the case of a hydrostatic piston machine in whose housing a cylinder drum is rotatably disposed, the cylinder bores of which can be connected alternately to a control kidney on the intake side and a control kidney on the delivery side, the maximum rotational speed which can be attained is substantially determined by the flow conditions when the pressure medium enters the cylinder bores from the control kidney on the intake side. The inflow of the pressure medium into the cylinder drums on the intake side can be improved by improvements in the fluidic boundary conditions. However, on account of the geometrical conditions, measures of this kind, such as, for example, an enlargement of the through-flow cross section by enlarging the opening in the cylinder drum or the area of the intake kidney, also have limits, as does an improvement of the inflow factor through rounded edges, for example.

It is in addition known from DE 30 18 711 C2 to impose a tangential velocity component on the pressure medium on the intake side, thereby preventing the occurrence of cavitation upon reaching the rotational speed limit. An impeller of a pump is disposed in a connection plate in order to generate a tangential velocity component. The additional pump acts as an auxiliary pump. Its impeller co-operates with a collector. The collector is formed as a channel of a varying flow cross section. The pressure medium which enters the region of the control kidney is composed of two components. On the one hand pressure medium which is directly accelerated by the impeller enters the control opening of the connection plate. On the other hand some of the pressure medium which is drawn in by the impeller is firstly delivered into the collector and returned in a tapering section of the collector to the impeller, where it undergoes further acceleration before it also enters the control kidney.

The described arrangement has the disadvantage of an additional pump which provides the pressure medium drawn in with additional energy being absolutely necessary. Moreover, the arrangement of the impeller in an axial extension of the shaft of the piston machine has the disadvantage of resulting in a significant increase in the construction space of the hydrostatic piston machine. It is in this case impossible to provide a different arrangement, since—on account of the special nature of the impeller the blade ends must be disposed directly in the region of the entrance into the control kidney.

The object of the invention is to provide a hydrostatic piston machine in which the rotational speed limit existing due to the flow conditions on the intake side is raised.

SUMMARY

A cylinder drum is rotatably mounted in a housing in the hydrostatic piston machine according to the invention. A plurality of cylinder bores are disposed in the cylinder drum, which bores can be connected via cylinder openings in the cylinder drum to a first or a second control opening. The cylinder openings of the cylinder bores are connected alternately to the first and the second control opening, respectively, during a rotation of the cylinder drum. The first control opening is connected to a low-pressure line and the second control opening to a high-pressure line. In order to produce a volume flow in the circumferential direction, a first connection of a channel and, lying opposite, a second connection of the channel are connected to the first control opening. The opposite arrangement of the two connections of the channel results in a secondary circuit, with the first control opening being provided as a component part of this secondary circuit. This results in a flow through the channel, with the fluid which flows through the channel being accelerated the pressure medium in each case drawn in from the low-pressure line and supplied via the first control opening to the cylinder bores. A tangential component is imposed on the pressure medium which is drawn in and is to be sucked into the cylinder bores through this acceleration.

The fact that just one additional channel has to be provided to generate the tangential velocity component is of particular advantage in this respect. In the simplest case it is possible to dispense entirely with an auxiliary pump. The formation of the flow does not arise through the acceleration by means of the blades of an impeller, but rather solely on account of the flow in the secondary circuit when pressure medium is drawn in from the low-pressure line. One portion of the pressure medium flowing through the control opening and drawn in from the low-pressure line is used to fill the cylinder, whereas the other portion flows into the channel which is connected to the control opening at the first connection. The pressure medium is returned via the channel to the second connection, where it meets the pressure medium flowing in from the low-pressure line and thus causes the pressure medium which is drawn in to be accelerated in the circumferential direction.

Advantageous developments of the hydrostatic piston machine according to the invention are set forth in the subclaims.

It is in particular of advantage to dispose the first and the second connection on a common circumferential circle which is disposed centrically about the axis of rotation of the cylinder drum. The direction of flow which is developed in the first control opening thus corresponds exactly with the direction of rotation of the cylinder drum.

The direction of flow in the first control opening and the direction of movement of the cylinder opening are therefore parallel along the first control opening, thereby improving the conditions of entry for the pressure medium into the cylinder bores. There is therefore no occurrence of cavitation, as feared, and the maximum rotational speed can be increased. It is in addition of particular advantage to dispose the sections of the channel which adjoin the first control opening tangentially in relation to the circumferential circle. The tangential arrangement of the sections in the region around the first control opening prevents eddy formation in the flow and therefore also the risk of the occurrence of cavitation.

In order to achieve particularly favourable acceleration of the pressure medium which is drawn in from the low-pressure line, it is of advantage for the low-pressure line to open into the channel. The pressure medium conveyed in a circuit in the channel and the pressure medium just drawn in from the low-pressure lines are therefore already mixed together and brought to a common velocity before entering the region of the first control opening. The pressure medium is then supplied via the common connection to the first control opening, so that there is no possibility of mutual negative influence of the direction of flow by two connections present in the region of the first control opening.

It is also of advantage to provide a connecting section of the channel on the outside of a connection plate of a hydrostatic piston machine. The casting geometries which are necessary to produce the connection plate can be kept simple through an external arrangement of this kind. It is merely necessary to provide the connections to the first control opening at the connection plate. Pipework can then be disposed in a simple manner on the outside of the connection plate by means of proven connecting and sealing techniques.

On the other hand, it is of advantage to form the channel completely inside the connection plate. No additional pipelines are required on the outside of the hydrostatic piston machine with a channel arrangement provided inside the connection plate. On the one hand this leaves the outer faces of the connection plate free, so that possibilities for connecting the delivery or high-pressure line can easily be implemented and, on the other hand, the channel is therefore protected against mechanical damage.

In this respect it is of particular advantage to dispose the channel in a section of the connection plate which is formed between the two control openings. The provision of the channel in the region between the two control openings results in optimised utilisation of the existing construction space of the connection plate. An enlargement of the connection plate, with the channel being accommodated in the enlarged region, is therefore unnecessary. Furthermore, the control opening is as a rule kidney-shaped, so that the flow takes place approximately along an oval when the channel is disposed between the control kidneys. There is therefore no need for deflections of any significance, as are necessary in the case of channel routing outside of the control kidney.

It may in addition be of advantage to connect the channel to an auxiliary pump. Even higher flow velocities can therefore be achieved inside the channel and the circumferential velocity of the pressure medium in the region of the first control opening can therefore be adapted to even higher rotational speeds.

BRIEF DESCRIPTION OF THE DRAWINGS

Embodiments of the hydrostatic piston machine according to the invention are represented in the drawings and illustrated in detail in the following description.

In the drawings.

DETAILED DESCRIPTION OF EXEMPLARY EMBODIMENTS

Figure 1:
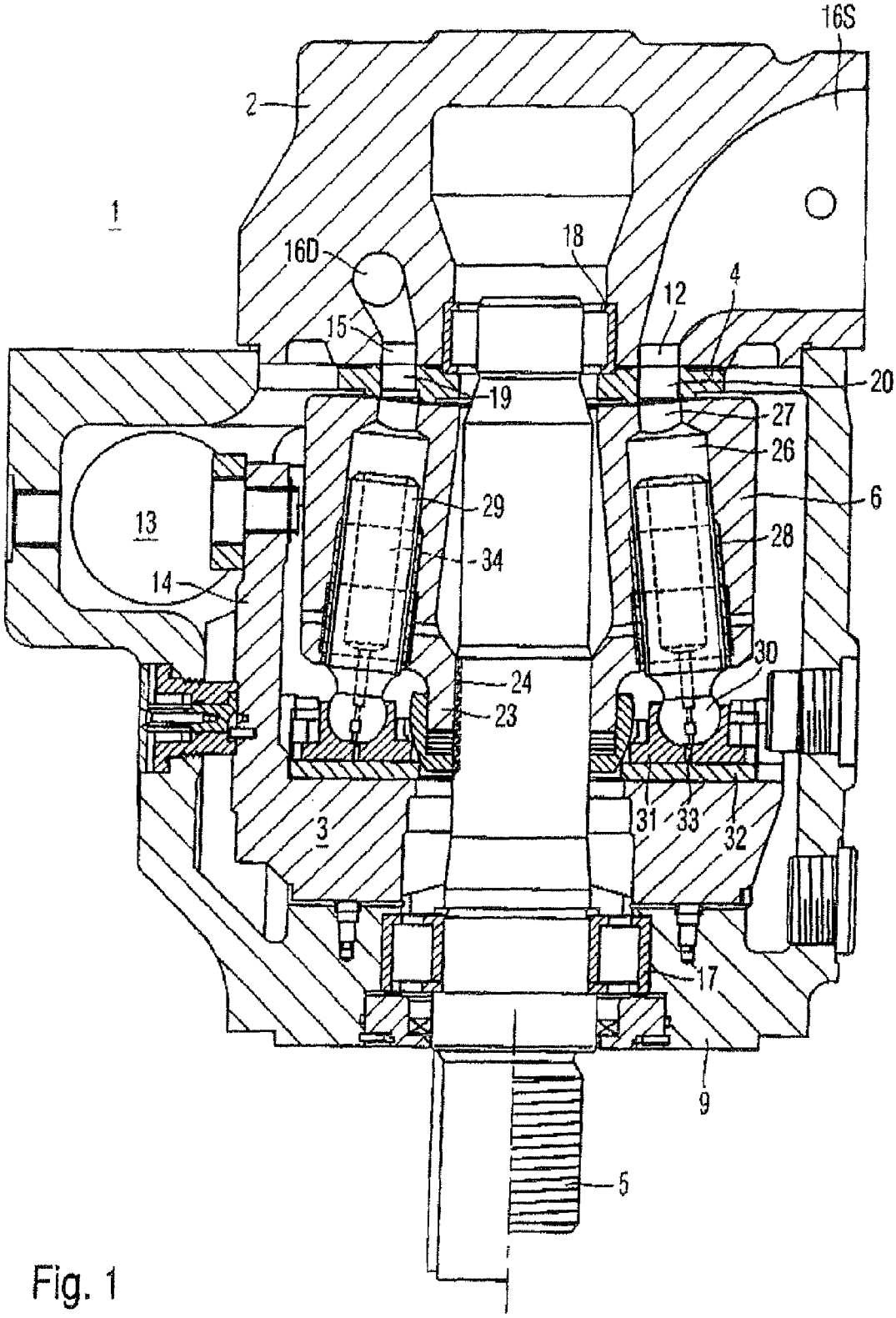
FIG. 1 is a sectional representation of a hydrostatic piston machine.

Before considering special embodiments for implementing a connection plate of a hydrostatic piston machine according to the invention, a hydrostatic piston machine 1 with its essential components shall firstly be illustrated for the purpose of a better understanding. The hydrostatic piston machine 1 comprises a connection plate 2 which, together with a housing part 9, forms a housing of the hydrostatic piston machine 1. A drive shaft 5 is rotatably mounted in a first bearing 17 and a second bearing 18 in the interior of the housing, with a section 24 of the drive shaft 5 being connected to a corresponding section 23 of a cylinder drum 6 in a rotationally rigid manner. At the end which faces the connection plate 2 the cylinder drum 6 lies against a control mirror 4 which in the represented embodiment is of spherical construction and thus centres the cylinder drum 6 at a corresponding recess.

A first control opening 12 and a second control opening 15 are provided in the connection plate 2 in order to connect a high-pressure line and a low-pressure line, respectively. The control openings 12 and 15 are connected via low-pressure and high-pressure connections 16S and 16D, respectively, to a low-pressure line and a high-pressure line, respectively, which are not represented in FIG. 1. In the represented embodiment the control mirror 4 comprises openings 19 and 20, respectively, which correspond with the first control opening 12 and the second control opening 15.

A plurality of cylinder bores 26 are disposed in the cylinder drum 6. The cylinder drum 12 comprises a cylinder opening 27 for each bore on the side which faces the connection plate 2. The cylinder openings 27 are disposed in the cylinder drum 6 such that they are connected alternately to the opening 19 and 20, respectively, and therefore to the first control opening 12 and the second control opening 15 when the cylinder drum 6 rotates.

Liners 28 are inserted in the cylinder bores 26. Pistons 29 are in each case disposed in the liners 28. The pistons 29 are connected via a ball joint connection 30 to a sliding shoe 31. The sliding shoe 31 is supported on a disc 32. A lubricating oil bore 33 is provided in the sliding shoe 31 for hydrostatically relieving the sliding shoes 31 and for lubricating the contact face between the sliding shoe 31 and the disc 32. The lubricating oil bore 33 is in contact with the cylinder bore 26 via a bore 34 disposed in the piston 29 and is therefore supplied with lubricant during a delivery stroke.

The disc 32 is firmly connected to a pivoting rocker 3, at which a lever arm 14 is disposed. The lever arm 14 is actively connected to an adjusting piston 13, whereby the angle of inclination of the pivoting rocker 3 relative to the axis of rotation of the drive shaft 5 can be adjusted. The pistons 29 execute a reciprocating movement in the cylinder drum 6 in their respective cylinder bores 26 on account of the inclination of the pivoting rocker 3. Pressure medium is then drawn into the cylinder bore 26 via the low-pressure connection 16S and the first control opening 12 during an intake stroke. The pressure medium which is displaced from the cylinder bore 26 by the piston 29 is accordingly delivered via the second control opening 15 and the high-pressure connection 16D into a working line, which is not represented, for example, during a delivery stroke.

Figure 2:
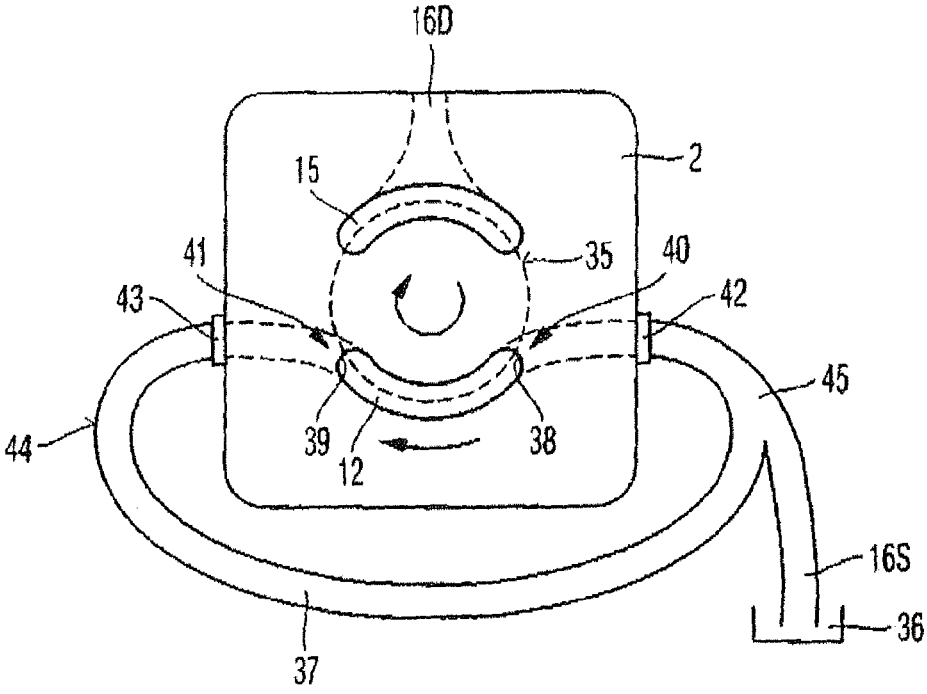
FIG. 2 is a schematic representation of a first embodiment of a connection plate of the hydrostatic piston machine according to the invention.

FIG. 2 is a schematic representation for a first embodiment of a connection plate 2 of a hydrostatic piston machine 1 according to the invention. The connection plate 2 is represented in FIG. 2 with its side which faces the interior of the hydrostatic piston machine 1. A first control opening 12 and a second control opening 15 can be seen in the connection plate 2. The first control opening 12 and the second control opening 15 are formed as control kidneys. The control kidneys extend along a circumferential circle 35, which is disposed centrically in relation to the axis of rotation of the drive shaft 5. The radius of the circumferential circle 35 corresponds to the distance of the centre of the cylinder openings 27 from the axis of rotation of the drive shaft 5. The cylinder openings 27 therefore coincide alternately with the first control opening 12 and the second control opening 15 during a rotation of the cylinder drum 6.

In the represented embodiment the second control opening 15 is connected via the high-pressure connection 16D to a working line, on the high-pressure side, of a hydraulic circuit, which is not represented in detail. On the other hand, the first control opening 12 is connected via the low-pressure connection 16S to a tank volume 36. The illustrated connection plate is provided to connect the hydrostatic piston machine 1 in an open circuit.

When the hydrostatic piston machine 1 is operated as a pump pressure medium is drawn in from the tank volume 36 via the low-pressure connection 16S and delivered during an intake stroke via the first control opening 12 and the cylinder openings 27 in each case connected thereto into the cylinder chambers 26. According to the invention, a channel 37 is provided which forms a secondary circuit and is connected via a first connection 38 and a second connection 39 to the first control opening 12. The channel 37 comprises a first section 40 and a second section 41, respectively, adjacent to the first connection 38 and the second connection 39, respectively. The first section 40, which adjoins the first connection 38, firstly extends along the circumferential circle 35 or tangentially before it is routed towards a pipe connection 42 to the outside of the connection plate 2.

The second section 41 of the channel 37 is accordingly also continued adjacent to the second connection 39 along the circumferential circle 35 or tangentially before it is routed out of the connection plate 2 towards a second pipe connection 43. According to the first embodiment, the first pipe connection 42 is connected to the second pipe connection 43 via external pipework 44. The external pipework is represented in one piece for the sake of simplicity. However it is equally possible to provide multipart pipework 44, in which case it may be of particular advantage to increase the flow velocity inside the channel 37 by means of an auxiliary pump disposed in the channel 37 or connected thereto.

In the represented embodiment the low-pressure connection 16S and the channel 37 are brought together outside of the connection plate 2. The channel 37 comprises a branch 45 for this purpose. The common entrance of the pressure medium drawn in via the low-pressure connection 16S and the pressure medium flowing in a circuit in the channel 37 via the first pipe connection 42 and the common first section 40 has the advantage of all the flowing pressure medium already having a largely homogeneous velocity distribution at the instant of entry into the first control opening 12. This relates both to the magnitude of the velocity and the direction of flow. The direction of flow is approximately parallel to the plane of the drawing and extends along the circumferential circle 35 in the direction which is indicated by the arrow. The direction of flow therefore corresponds with the direction of rotation of the cylinder drum 6, with the rotational speed preferably corresponding with the flow velocity along the circumferential circle 35 of the first control opening 12.

In order to supply the pressure medium from the tank volume 36, it is also possible to replace the branch 45 outside of the connection plate 2 by a low-pressure connection 16S which is connected via a separate connection point to a corresponding channel inside the connection plate 2. The channel 37 is in each case to be constructed so as to have the least possible losses.

Figure 3:
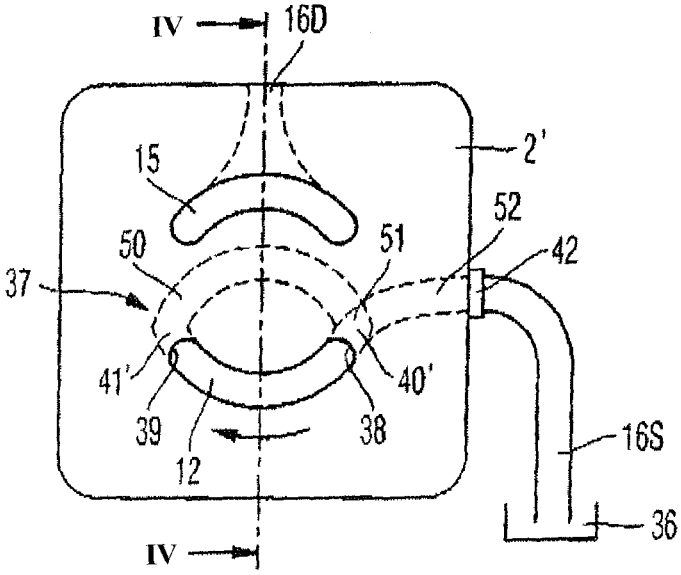
FIG. 3 is a schematic representation of a second embodiment of a connection plate of a hydrostatic piston machine according to the invention and FIG. 4 is a view of the connection plate along the section IV-IV of FIG. 3.

A further configuration of a connection plate 2' is represented in FIG. 3. In contrast to the embodiment previously illustrated, in the embodiment of FIG. 3 the channel 37 is constructed as an internal channel inside the connection plate 2'. The channel 37 is in this case preferably also continued in the circumferential direction in the region of the sections 40' and 41' adjacent to the first connection 38 and the second connection 39, respectively. The first section 40' and the second section 41' are connected together via a connecting section 50 of the channel 37, with this connecting section 50 being disposed between the first control opening 12 and the second control opening 15.

The pressure medium pumped in a circuit in the channel 37 and the pressure medium drawn in via the low-pressure connection 16S are brought together in a joining region 51, which is preferably disposed in the region of the first section 40'. The disposal of the joining region 51 in the region of the first section 40' ensures that the two component flows in the channel 37 and the low-pressure connection 16S, respectively, achieve a uniform direction of flow before entering the first control opening 12 at the first connection 38.

Both in FIG. 2 and in FIG. 3 the representation in broken lines indicates that the individual channel sections and connections lie in a region of the connection plate 2 or 2' which is not visible and are not open towards the visible area of the connection plates 2 and 2' which is represented in FIGS. 1 and 2.

Figure 4:
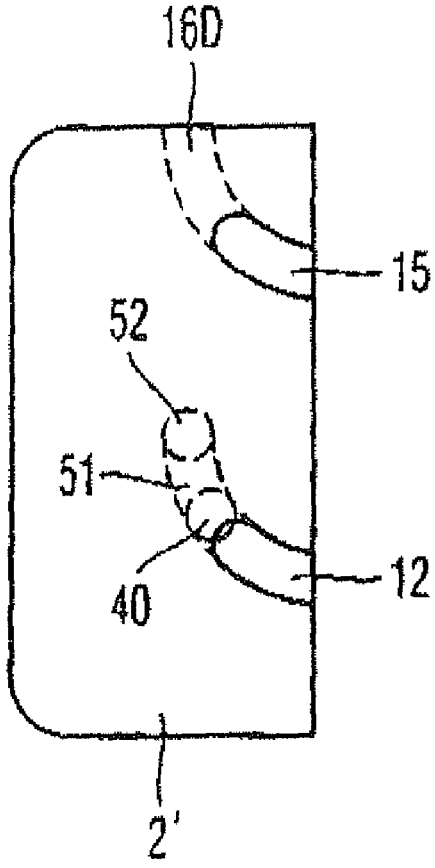

FIG. 4 is a sectional representation of the connection plate 2' along the line IV-IV. The side of the connection plate 2' which faces the housing interior of the hydrostatic piston machine 1 is represented on the right-hand side of FIG. 4. The mouths of the first control opening 12 and the second control opening 15 can accordingly be seen. In the represented embodiment an intake line channel 52 and the first section 40' open in the joining region 51 adjoining the first control opening 12. The two component flows join in the joining region 51 and flow together into the region of the first control opening 12.

The invention is not restricted to the representative examples which are set forth. On the contrary, individual features of the embodiments may also be combined in any desired manner.

The invention claimed is:

1. A hydrostatic piston machine with a cylinder drum which is rotatably mounted in a housing and in which a plurality of cylinder bores are disposed, which bores are connected via cylinder openings provided in the cylinder drum to a first control opening and a second control opening, wherein the first control opening is connected to a low-pressure line and the second control opening to a high-pressure line, wherein the control openings are disposed as control kidneys on a circumferential circle, which is disposed about an axis of rotation of the cylinder drum, wherein a first connection and a second connection are formed at opposite ends of the first control opening in a circumferential direction, and wherein the first connection and the second connection are connected to each other through a channel forming a secondary circuit, wherein the secondary circuit only communicates with the first control opening through the first connection and the second connection.

2. The hydrostatic piston machine according to claim 1, wherein the first connection and the second connection lie on the circumferential circle which is disposed about the axis of rotation of the cylinder drum.

3. The hydrostatic piston machine according to claim 1, wherein sections of the channel which adjoin the first and/or the second connection extend along the circumferential circle.

4. The hydrostatic piston machine according to claim 1, wherein the low-pressure line opens into the channel.

5. The hydrostatic piston machine according to claim 1, wherein the piston machine is a hydrostatic pump in an open circuit and the low-pressure line is an intake line.

6. The hydrostatic piston machine according to claim 1, wherein at least one connecting section of the channel is formed as external pipework at a connection plate.

7. The hydrostatic piston machine according to claim 1, wherein the channel is formed in a connection plate.

8. The hydrostatic piston machine according to claim 7, wherein the channel is disposed in a section of the connection plate which is formed between the first control opening and the second control opening.

9. The hydrostatic piston machine according to claim 1, wherein the channel is connected to an auxiliary pump.

* * * * *